US006470159B2

(12) United States Patent
Dycher

(10) Patent No.: US 6,470,159 B2
(45) Date of Patent: Oct. 22, 2002

(54) RETRACTABLE SHIELD FOR PHOTOSENSITIVE MEMBER

(75) Inventor: David Keith Dycher, Port Erin (GB)

(73) Assignee: GCC Management Limited, Kowloon (HK)

( * ) Notice: Subject to any disclaimer, the term of this patent is extended or adjusted under 35 U.S.C. 154(b) by 0 days.

(21) Appl. No.: 09/790,903

(22) Filed: Feb. 23, 2001

(65) Prior Publication Data

US 2002/0118980 A1 Aug. 29, 2002

(51) Int. Cl.[7] ..... G03G 21/18
(52) U.S. Cl. ..... 399/114
(58) Field of Search ..... 399/111, 114, 399/91, 159, 116

(56) References Cited

U.S. PATENT DOCUMENTS

| | | | | |
|---|---|---|---|---|
| 4,327,992 A | | 5/1982 | Babicz | |
| 4,462,677 A | | 7/1984 | Onoda | |
| 4,470,689 A | | 9/1984 | Nomura et al. | |
| 4,538,896 A | | 9/1985 | Tajima et al. | |
| 4,583,832 A | * | 4/1986 | Kasamura et al. | 399/119 |
| 5,500,714 A | | 3/1996 | Yashiro et al. | |
| 6,091,916 A | | 7/2000 | Dycher | |
| 6,236,822 B1 | * | 5/2001 | Kawaguchi | 399/114 |

FOREIGN PATENT DOCUMENTS

| | | | | |
|---|---|---|---|---|
| GB | 2 101 933 A | | 6/1982 | |
| JP | 63015267 A | * | 1/1988 | G03G/15/00 |
| JP | 2000147980 A | * | 5/2000 | G03G/21/18 |

* cited by examiner

*Primary Examiner*—Robert Beatty
(74) *Attorney, Agent, or Firm*—Liniak, Berenato & White

(57) ABSTRACT

A process unit for use in an electrophotographic image forming apparatus includes a carrying handle, a photosensitive member, a process device and a moveable cover connected to the process unit and shielding an area of the periphery of the photosensitive member. The cover is designed to retract from its shielding position for the process unit and is installed into the body of the image forming apparatus. Retraction of the cover is preferably caused by the action of grasping the handle.

4 Claims, 15 Drawing Sheets

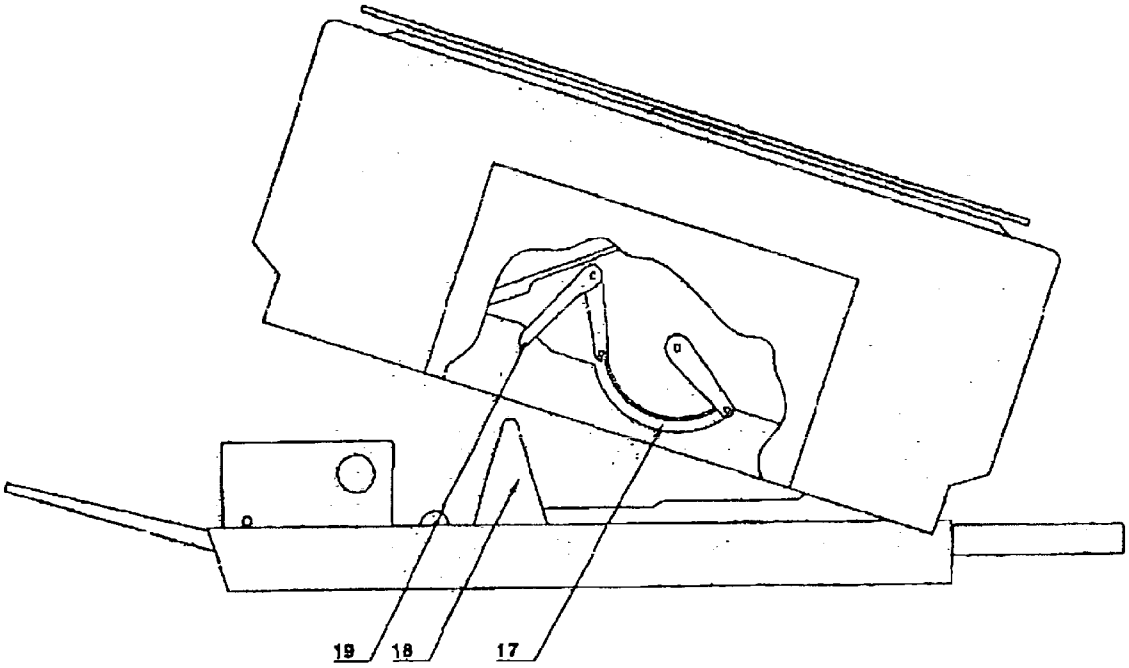
Figure 2 - Prior Art

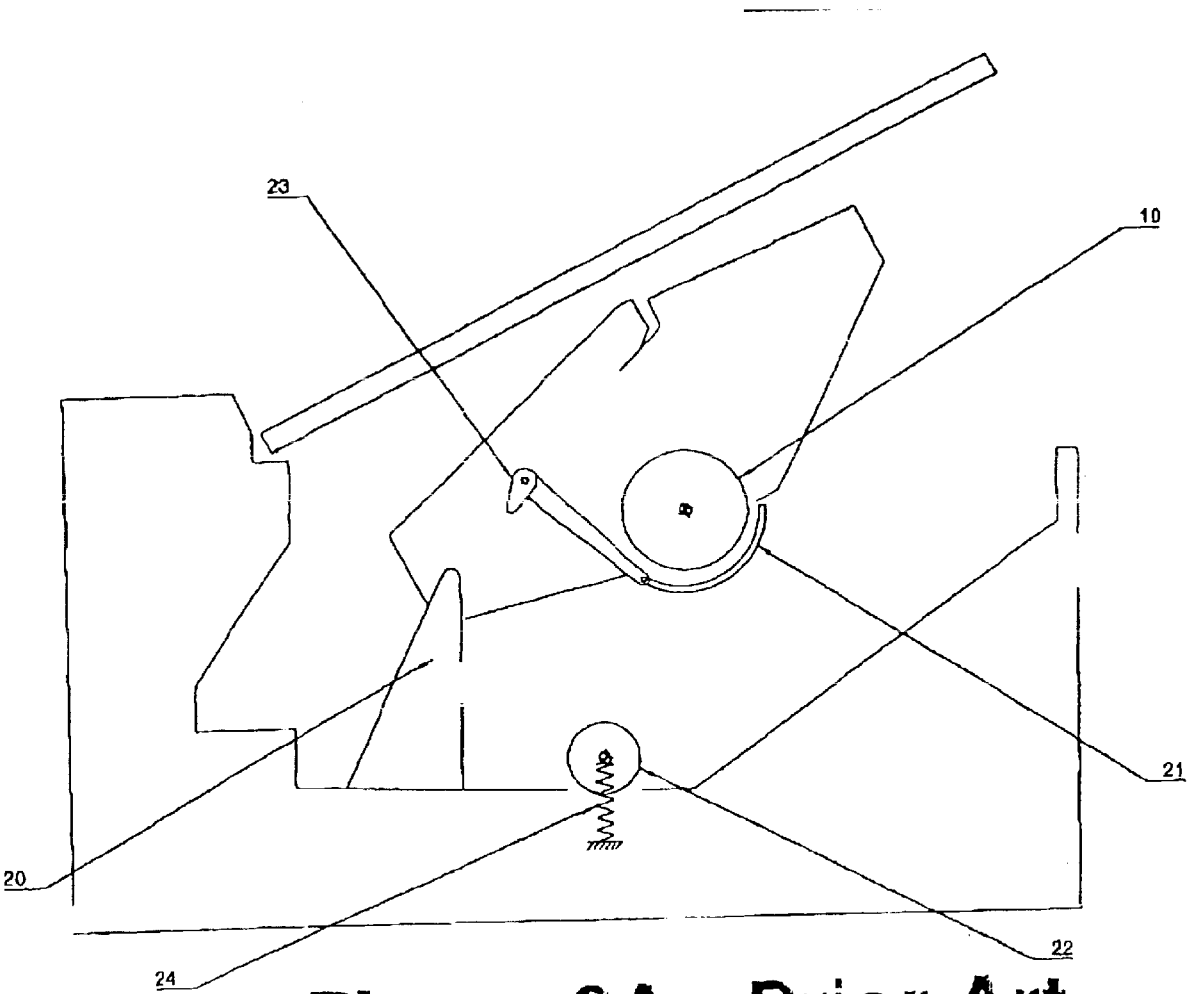
Figure 3A - Prior Art

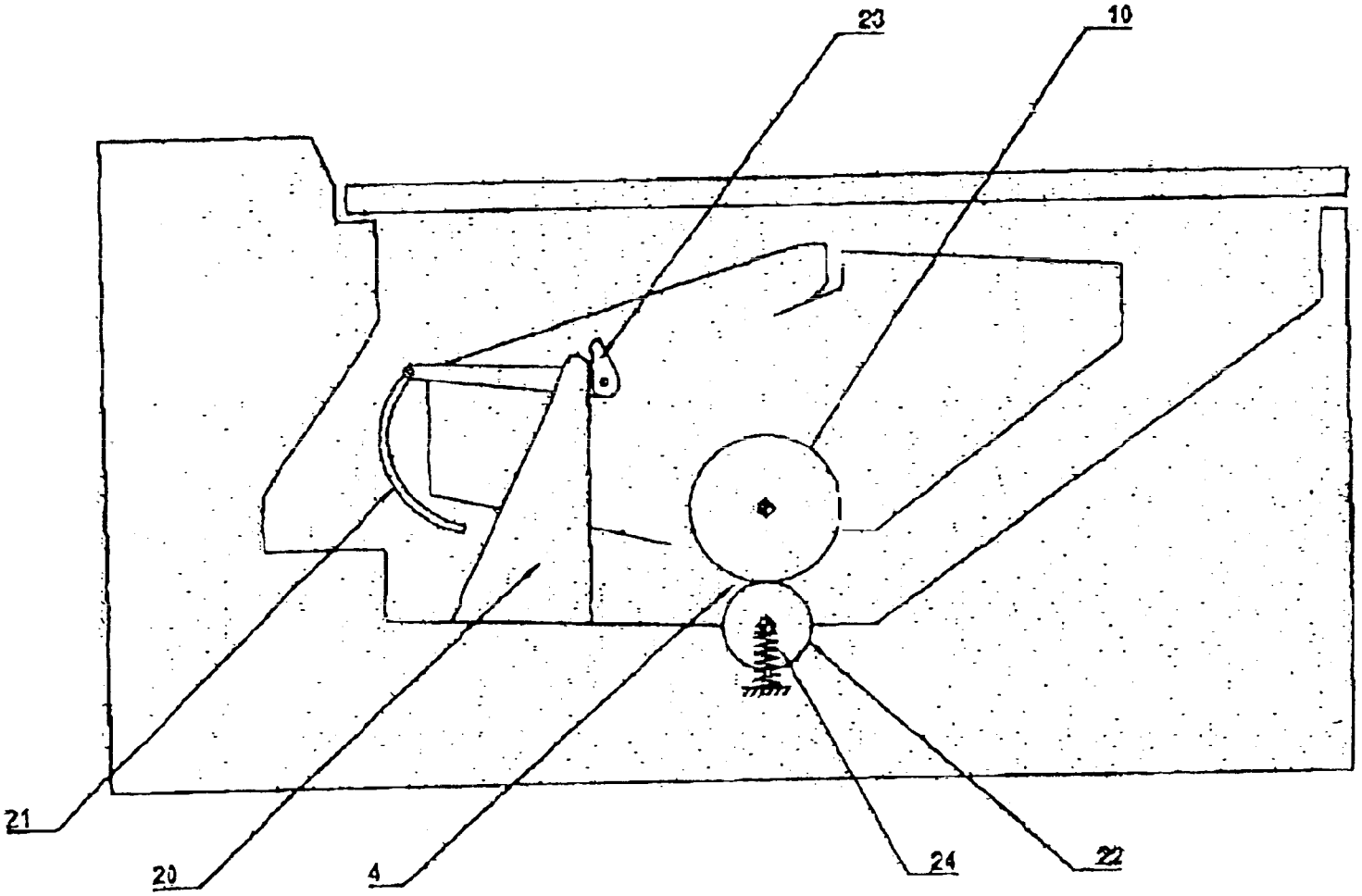
Figure 3B - Prior Art

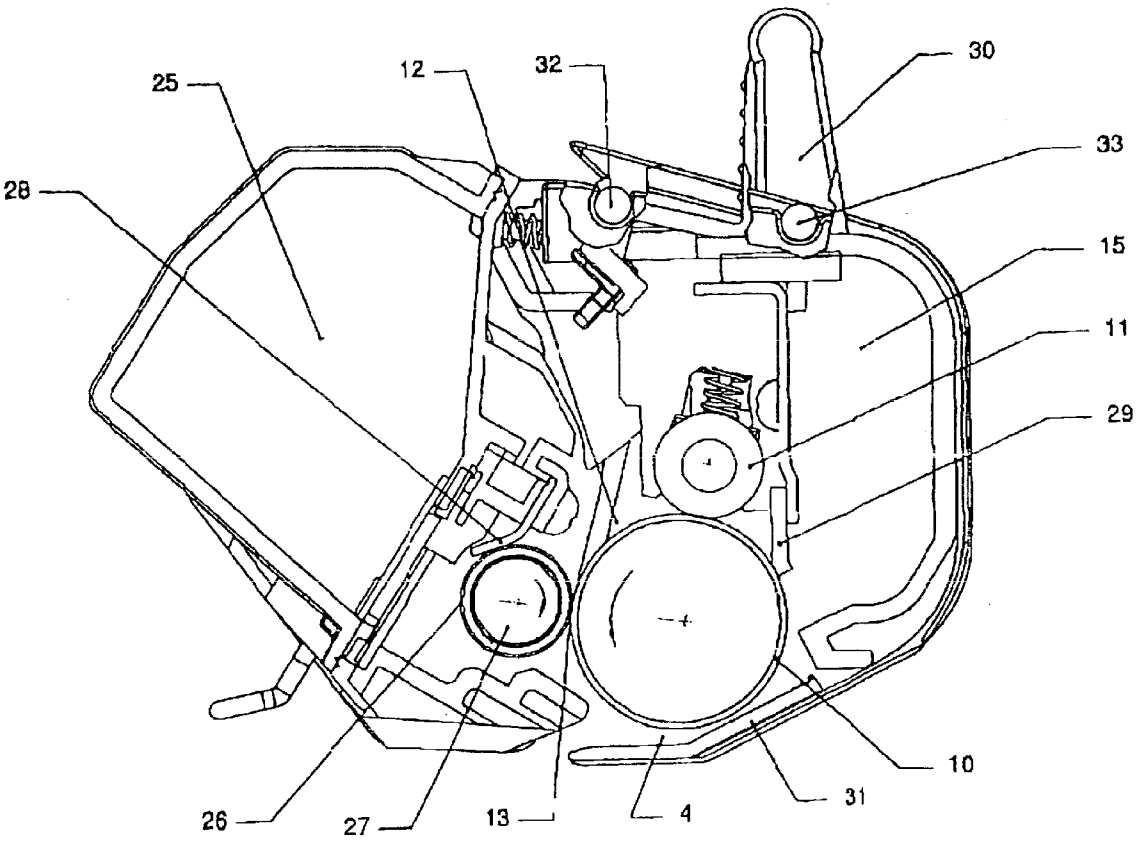
Figure 4 - Prior Art

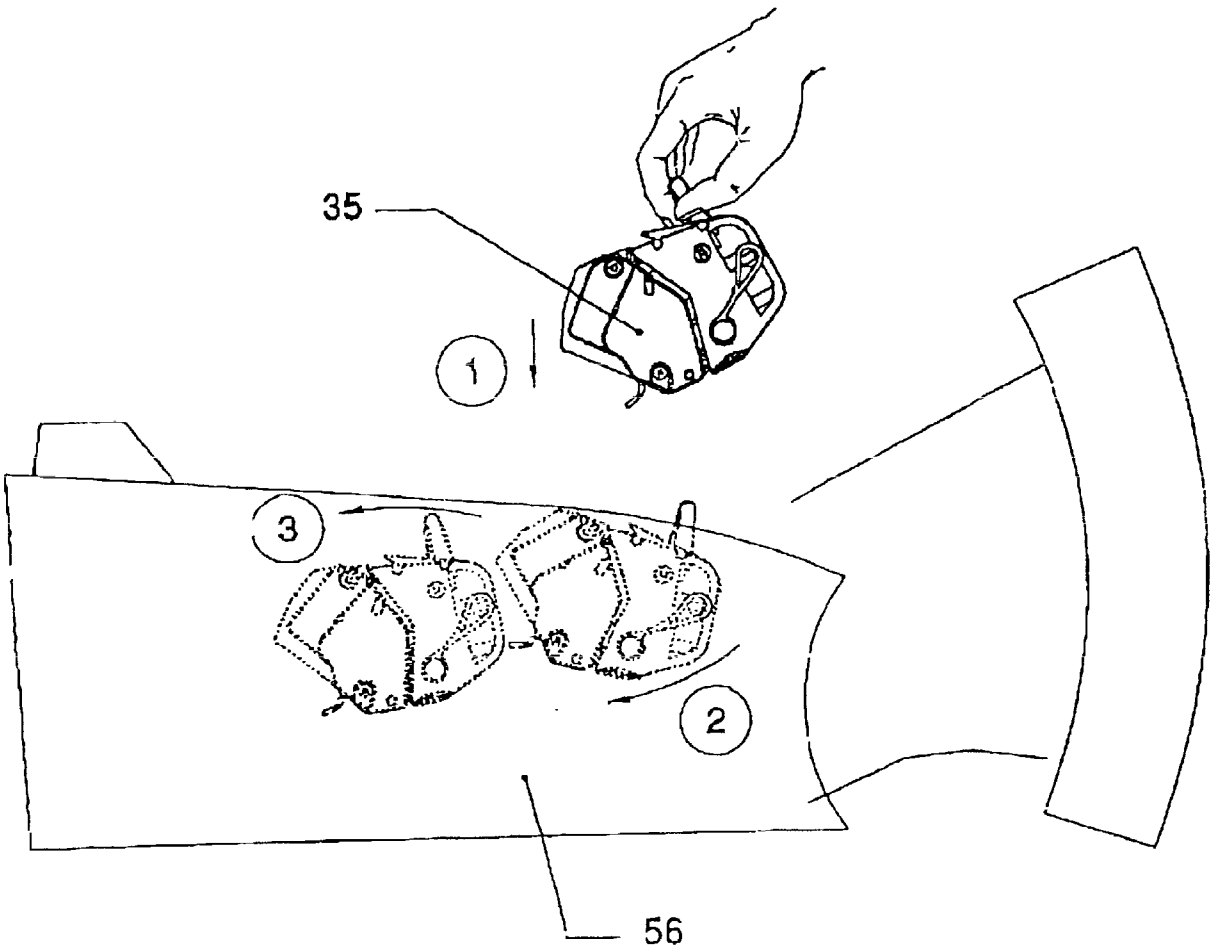
Figure 7 - Prior Art

RETRACTABLE SHIELD FOR PHOTOSENSITIVE MEMBER

FIELD OF INVENTION

The present invention relates to an electrophotographic process unit, including a photosensitive member and process means, detachably mounted in an apparatus for forming images.

The concept of a removable process unit was disclosed in U.S. Pat. No. 4,327,992 which discloses a copying apparatus in which the serviceable parts, including a photosensitive member and a developer unit, are mounted on a drawer frame which can be easily withdrawn from the main unit in order that service of the consumable parts might take place.

U.S. Pat. No. 4,538,896 discloses a process unit which is removable from the main image forming unit and is intended to be discarded. This allows the user to perform a preventive maintenance task without specialised assistance from a Service Technician.

GB 2,101,903 discloses a user removable process unit fitted with a cover to shield the photosensitive member. This cover is movable between two positions; the first to expose the photosensitive member for the purposes of image transfer and the second to shield it. Acknowledging that the user is handling a sensitive part of the apparatus and may wish to re-install it at a later date for the purposes of colour changing or clearing a paper jam, the disclosure seeks to provide protection for the photosensitive drum when the process unit is in unskilled hands.

U.S. Pat. No. 4,462,677 discloses a cover which is actuated by the opening of the paper path such as in a clam shell copier arrangement.

U.S. Pat. No. 4,470,689 discloses a cover which is actuated by the removal of the process unit from the image forming apparatus.

The latter three documents disclose embodiments which require a discrete actuating system which is not part of the image forming mechanism to effect the opening or closing of the drum cover. U.S. Pat. No. 6,091,916 discloses a cover which is actuated by the movement of one of the process elements in the image forming system.

The placement of the process unit into the image forming apparatus is critical with respect to both the required positional location of the unit within the apparatus and also the force required to install it. Furthermore the path by which the cartridge is installed has in recent years become more convoluted due to the compact nature of the various machines and also the need to bring various process elements into contact along closely defined vectors. The need to balance the cartridge as it is installed is highlighted in U.S. Pat. No. 5,500,714 where an offset grip is provided to enable better balancing of the process unit as it is inserted.

BACKGROUND OF THE INVENTION

The invention provides a process unit for use in an electrophotographic image forming apparatus comprising:

a carrying handle;

a photosensitive member;

process means;

a movable cover connected to the process unit and shielding an area of the periphery of the photosensitive member:

arranged such that the cover is designed to retract from its shielding position before the process unit is installed into the body of the image forming apparatus.

In a particularly preferred embodiment the present invention enables the user to manually open the cover as part of the act of gripping the handle provided an the process unit. Hence the cover is opened prior to the process unit engaging the guideways within the image forming apparatus at which point the balance and attitude of the cartridge become critical.

Thus there are fewer forces on the process unit than in conventional systems whereby an actuator is provided to open the cover during installation; and therefore the user has more control in ensuring accurate positional installation with the minimum of force required.

Two methods are disclosed whereby the user might manually effect the opening of the cover by gripping the handle. The first is a panel levered against the handle and splaying outwards when the cover is in the closed position. When the user grasps the handle he squeezes the panel against the body of the handle and linkages therefrom provide for the opening of the cover.

The second method involves the entire handle being rotationally moveable between two positions. At rest the handle is inclined at a first angle to the process unit and the cover is closed. When the user picks up the unit and extends the unit into the interior of the image forming apparatus, the gravity of the tilting process unit causes the handle to rotate to a second angle which is linked to the opening of the cover.

A beneficial effect of the second method is that the second rotational position of the handle, and therefore the changed attitude of the process unit relative to the handle, allows for an easier and more balanced insertion of the process unit into the image forming apparatus.

The above and other objects and advantages of the present invention shall be made apparent from the accompanying drawings and the description thereof.

BRIEF DESCRIPTION OF THE DRAWINGS

The accompanying drawings, which are incorporated in and constitute part of this specification, illustrate embodiments of the invention and, together with a general description of the invention given above, and the detailed description of the embodiments given below, serve to explain the principles of the invention.

FIG. 2 shows a prior art image forming apparatus of a clam shell design which contains a process unit and utilises a mechanical actuator to move the drum cover when the image forming apparatus is opened or closed.

FIGS. 3A and 3B show a prior art image forming apparatus (laser beam printer) whereby an actuator causes the drum cover to move into an open position when the process unit is inserted into the image forming apparatus. FIG. 3A shows the process unit prior to installation and FIG. 3B shows the process unit installed inside the main body of the apparatus with the drum cover in the open position.

FIG. 4 shows a sectional schematic of a prior art compact process unit, which is designed to be inserted all the way into its operational position by the user.

FIG. 7 illustrates the attitude of a process unit of the type illustrated in FIG. 4 during the stages of the insertion process.

FIG. 8A shows the process unit before handling and prior to insertion. FIG. 8B shows the handle after it has been grasped and the cover open.

FIG. 9A shows the cover in the closed position. FIG. 9B shows the handle in the tilted position and the cover open

DETAILED DESCRIPTION OF SPECIFIC EMBODIMENTS

This invention relates to a process unit which forms a part of an image forming apparatus and contains process means for forming an electrophotographic image and which in normal use would be replaced by unskilled users. The image forming apparatus may be an electrophotographic copier; a laser beam printer; a fax machine; or a combination of either or all of these. The process means may comprise a magnetic brush system for transporting mono- or dual component developer from locations in one or more hoppers to a developing station whereby the developer and/or toner is presented to a latent image on the photosensitive drum.

Other process means may comprise the charging mechanism for the photosensitive drum; the transfer mechanism; and/or the cleaning mechanism.

Figure 1:
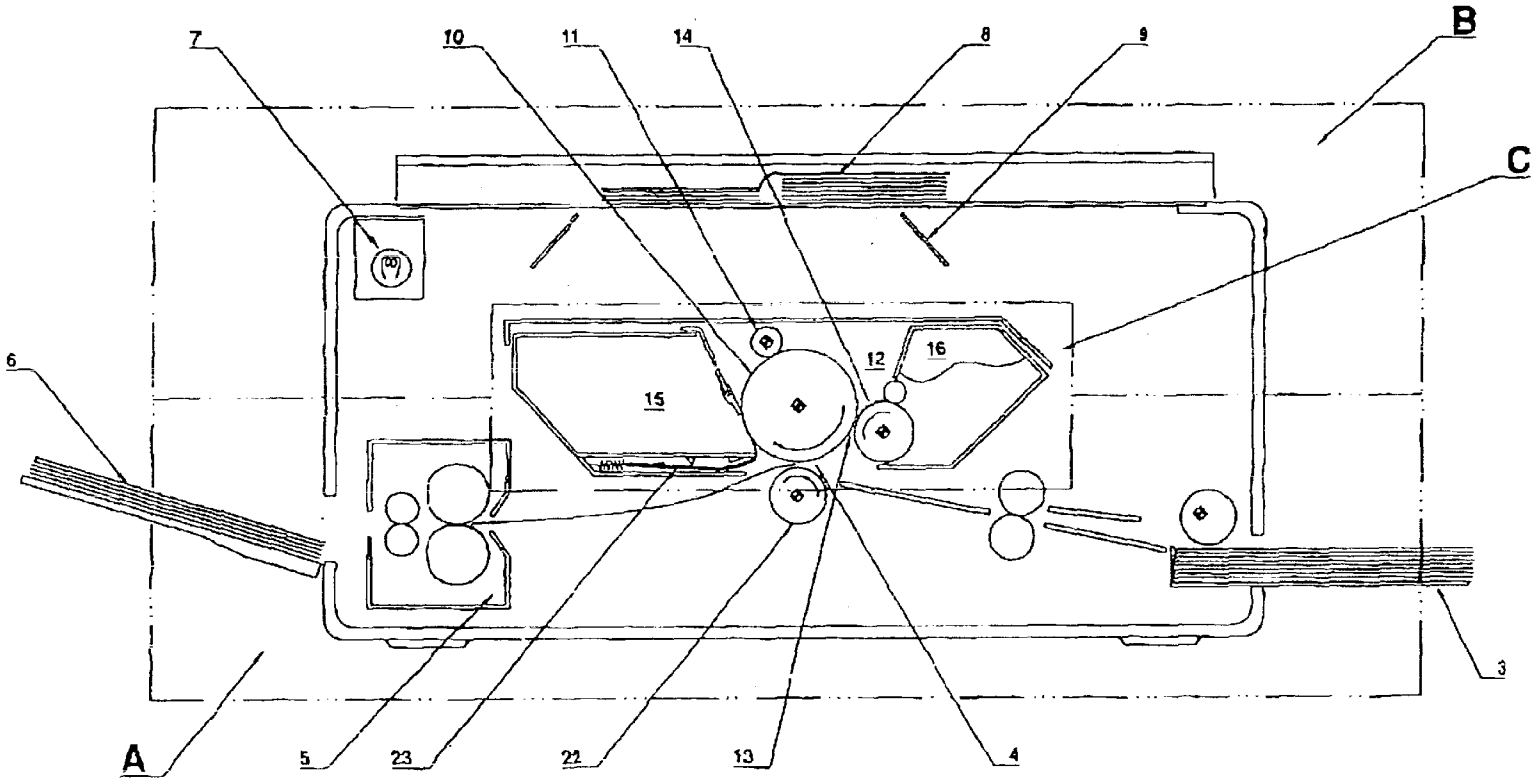
FIG. 1 shows a schematic of an image forming apparatus (electrophotographic copier) indicating those parts which may be enclosed in a process unit

With reference to FIG. 1, an image forming apparatus such as an electrophotographic copying machine can be divided into four Sections. The so-called base engine (A) comprises the paper handling mechanisms which feed the paper from a storage cassette (3) through an image receiving section (4) to a fixing unit (5) which employs temperature and pressure to fix the image onto the receiving medium. There is then an output tray (6) to which the medium is fed. The second Section is the image forming section (B) which comprises a light source (7) illuminating an image to be copied (8), this illumination being reflected off the subject image through an optical system (9) and finally focused on to a photosensitive drum (10). The photosensitive drum is part of the third main Section which may be termed the xerographic section (C). The drum (10) is charged by a charging device (11) prior to exposure to said light image. Having rotated past the image receiving section (12) where the charged surface is selectively discharged to form an electrical version of the image (latent image) the surface of the photosensitive drum passes a development zone (13) where a layer of toner and/or developer (14) is exposed to the latent image and electrostatic and/or magnetic forces cause the toner to transfer to the surface of the drum in the pattern of the latent image. The drum rotates further to a transfer section (4) where electrical and/or electrostatic forces cause the toner to transfer to the receiving medium. Any toner or developer remaining on the drum is cleaned off at a cleaning station (15). The fourth Section (D—not shown) of such a copying device is the control electronics which comprise power supplies and controllers for supervising the various operations of the machine.

In digital applications such as laser beam printers or digital copiers, Section B differs in that a laser beam is used to generate the light image. The beam is modulated or pulsed to form "light dots" which are scanned in a raster fashion across the photosensitive drum. Section D differs in that substantial hardware and software are dedicated to image preparation and rasterisation of the page image. Sections A and C can be very similar to the electrophotographic copier described above.

Many of the consumable items of the image forming apparatus are contained in Section C. Section C comprises a removable process unit which may be removed by the user (a) during the life of the process unit to clear paper jams or to exchange for a process unit containing toner of a different colour, or (b) when the toner powder contained in the hopper (16) is exhausted and the user either discards the process unit or returns the process unit for recharging and refurbishing.

It is the handling of the process unit by a person who is not necessarily skilled at photocopier maintenance which necessitates a shield to protect the photosensitive drum. This protection is designed to avoid physical and light damage to the photosensitive layer on the drum during transportation, storage and unpacking paper jam clearing and process unit exchange during the life of the process unit; and finally extraction, repacking and shipment to a remanufacturer when one of the consumables in the process unit, such as toner, becomes exhausted.

In most designs and also in the preferred embodiment of the invention, the drum cover needs to be moved in order that image transfer (station 4 in FIG. 1) can take place.

FIG. 2 shows a prior art arrangement where the drum cover (17) is normally in the closed position to shield the drum. However when the clam-shell machine is closed an actuator (18) in the base engine operates a lever (19) on the process unit which opens the cover and enables image transfer.

FIGS. 3A and 3B show another prior art arrangement in which a mechanism is provided for closing the drum cover as the process unit is removed from the image forming apparatus. In this case a post (20) provided in the process unit receiving area activates a lever (23) mounted on the process unit as the process unit is inserted. This lever in turn swings the cover (21) away from the transfer station area. FIG. 3A shows the cartridge prior to installation and FIG. 3B shows the cartridge after installation.

In FIG. 3B it can be seen that after installation of the cartridge the cover has been moved away from the transfer area (4) by the actuator lever and then the photosensitive drum (10) comes into contact with the transfer roller (22). The function of the transfer roller is to feed the paper through the transfer zone (4) of the electrophotographic image forming apparatus and at the same time provide an electrostatic bias which has the effect of drawing toner from the photosensitive drum (10) and onto the paper medium. When the photosensitive drum approaches the transfer roller it is preferable for the surfaces to come into contact perpendicularly to their mutual tangent. This minimises the chance of damage to either roller. However this can sometimes mean that the path by which the process unit is installed can become convoluted.

In prior art such as that shown in FIGS. 3A and 3B the process unit is first mounted in the upper half of the printer and hinges between the two halves then guide the process unit into the appropriate relationship with mating components (such as the transfer roller (22)) when the top half is closed. Thus a reasonable control is employed to ensure correct placement, even in unskilled hands. However in smaller units this mechanism of installation may not be practicable, due to size or other constraints, and guideways may be provided to enable accurate installation of the process unit directly by the user into the operating position. To accomplish this it is desirable that the user is presented with an insertion path which is not an ergonomic burden and which is intuitive to the user. However the guideways towards the end of the installation path must be designed so as to place the process cartridge very precisely into its operational position and often from a very specific direction. These requirements can often necessitate a change in attitude and direction of the process unit during the installation process.

FIG. 4 illustrates the sectional view of a prior art compact process unit designed for personal or small office users, who require inexpensive, compact laser printers, often with a throughput speed of 6 pages per minute or less. This unit contains all the xerographic elements of Section C in FIG. 1 but arranged in a different manner. A charge roller (11) transfers charge to an electrophotographic drum (10) which rotates such that the charged surface passes through a discharge zone (12) where the surface of the photoconductor is selectively discharged according to the image transmitted by information carrying light beams (not shown). Magnetic toner powder from the reservoir (25) is fed onto a rotating developer roller (26) containing a stationary magnet (27) which draws the magnetic toner to the surface of the rotating roller. The layer of toner thus formed on the surface of the rotating roller (26) passes beneath and is agitated by a charging blade (28) which meters the toner layer and imparts a triboelectric charge to the toner, most of which is the same polarity as that remaining on the electrophotographic drum in the non-discharged areas. As the developer roller rotates the toner is presented to the electrophotographic drum's surface at the developing station (13) wheretoner transfers to the discharged areas and develops the latent image into a positive image on the surface of the electrophotographic drum. After this image has been transferred to a receiving medium (not shown) at the transfer station (4) any remaining toner powder is cleaned from the electrophotographic member by a blade arrangement (29) and collected in the waste reservoir (15). The process unit is provided with a handle (30) by which the process unit can be installed into and removed from the image forming apparatus by the user. Also provided is a drum cover (31) which is hinged to the process unit casing at (32) and swings out from its shielding position when the process unit is inserted into the image forming apparatus. This retraction is caused by the interaction between a peg (33) on the arm of the cover which is activated by an inner surface of the image forming apparatus during the insertion of the process unit therein.

Figure 5A:
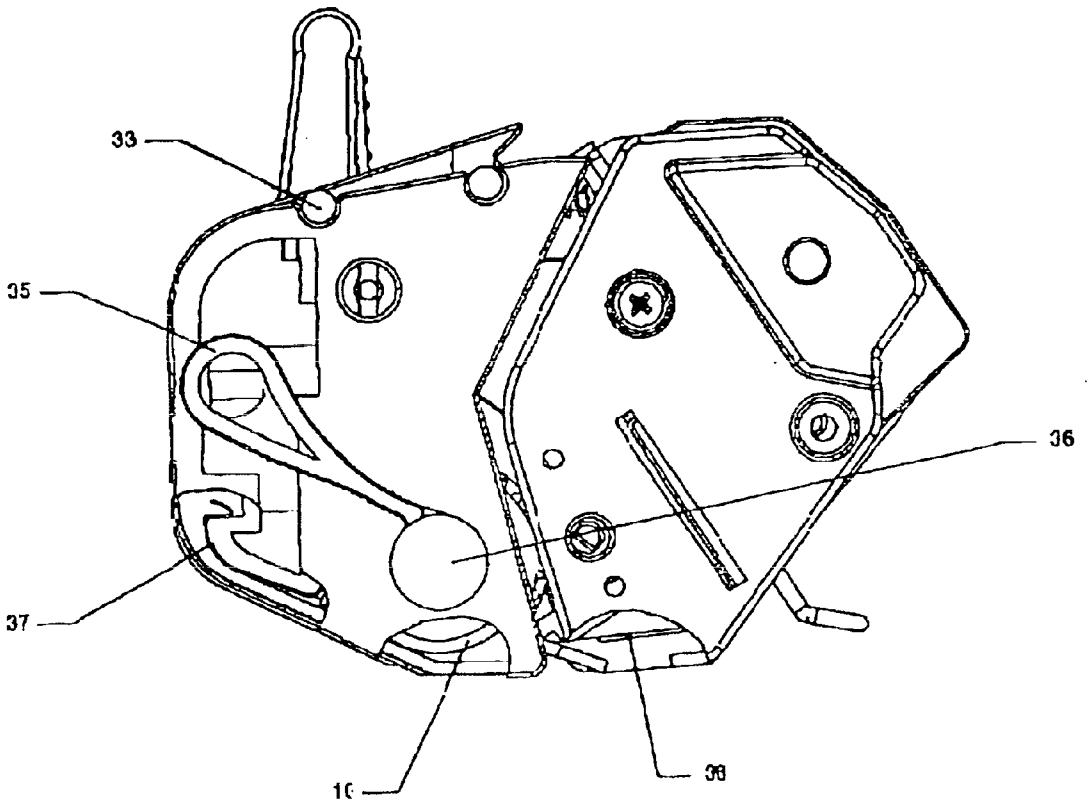
FIGS. 5A and 5B show the lateral ends of a process unit of the type illustrated in FIG. 4. Elements which interact with an image forming apparatus are indicated.

FIG. 5A shows the same type of cartridge as FIG. 4, but illustrating features on or near one end of the process unit which interact with the image forming apparatus when the process unit is installed. There are two guide bosses, (35) and (36) which guide the unit into the image forming apparatus along a guide channel. Boss (36) has an electrical contact on its outer periphery which transmits current from the inner surface of the electrophotographic drum to the machine earth. Further electrical contacts are provided and shown in cut-away at (37) and (38). These contacts transmit high bias voltages to the Charge Roller and Developer Roller respectively, from a high voltage supply in the imaging apparatus. There are two other points of physical interaction: (10) the electrophotographic member (again shown in cut-away) is required to contact the transfer roller in the image forming apparatus; and (33) is the peg which contacts with a surface inside the image forming apparatus to force open the drum cover.

Figure 5B:
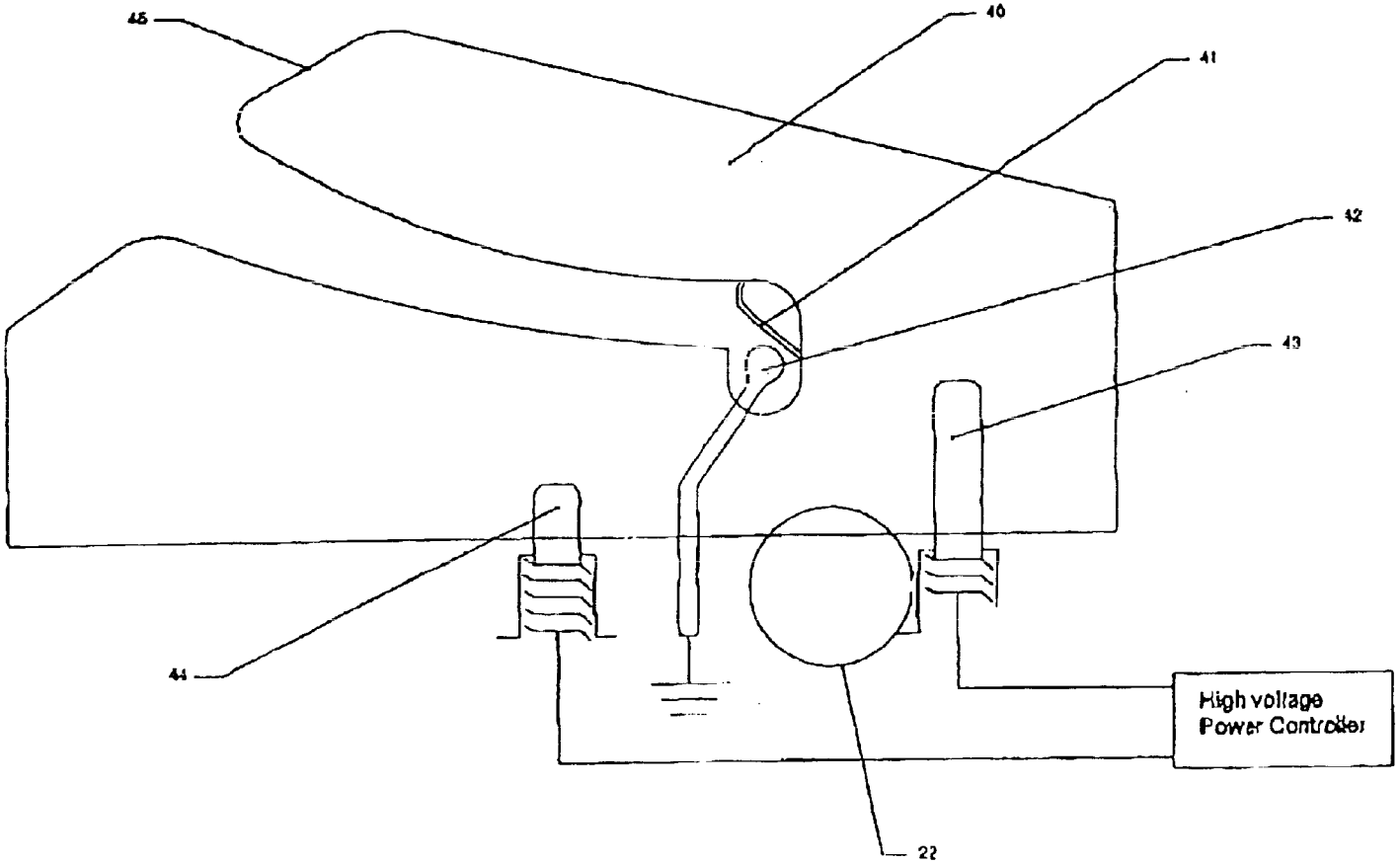

FIG. 5B shows the corresponding elements mounted in the image forming apparatus which interact with the process unit as it is inserted. A guide moulding (40) contains a slot along which the guide bosses ((35) and (36) from FIG. 5A) slide when the process unit is mounted. It can be seen that the path is curved and then the front boss (36) drops into place under the influence of a spring clip (41). When boss (36) is in position the contact on the periphery comes into contact with the spring clip electrode (42) to complete the circuit to machine ground. At the same time two other spring loaded electrodes (43) and (44) come into sliding contact with the Developer Roller and Charge Roller contacts respectively on the process unit. The bend in the guideway also ensures that the electrophotographic member drops perpendicularly onto the transfer roller (22). Surface (45) on the moulding makes sliding contact with the peg ((33) from FIG. 5A) to open the drum cover.

Figure 6A:
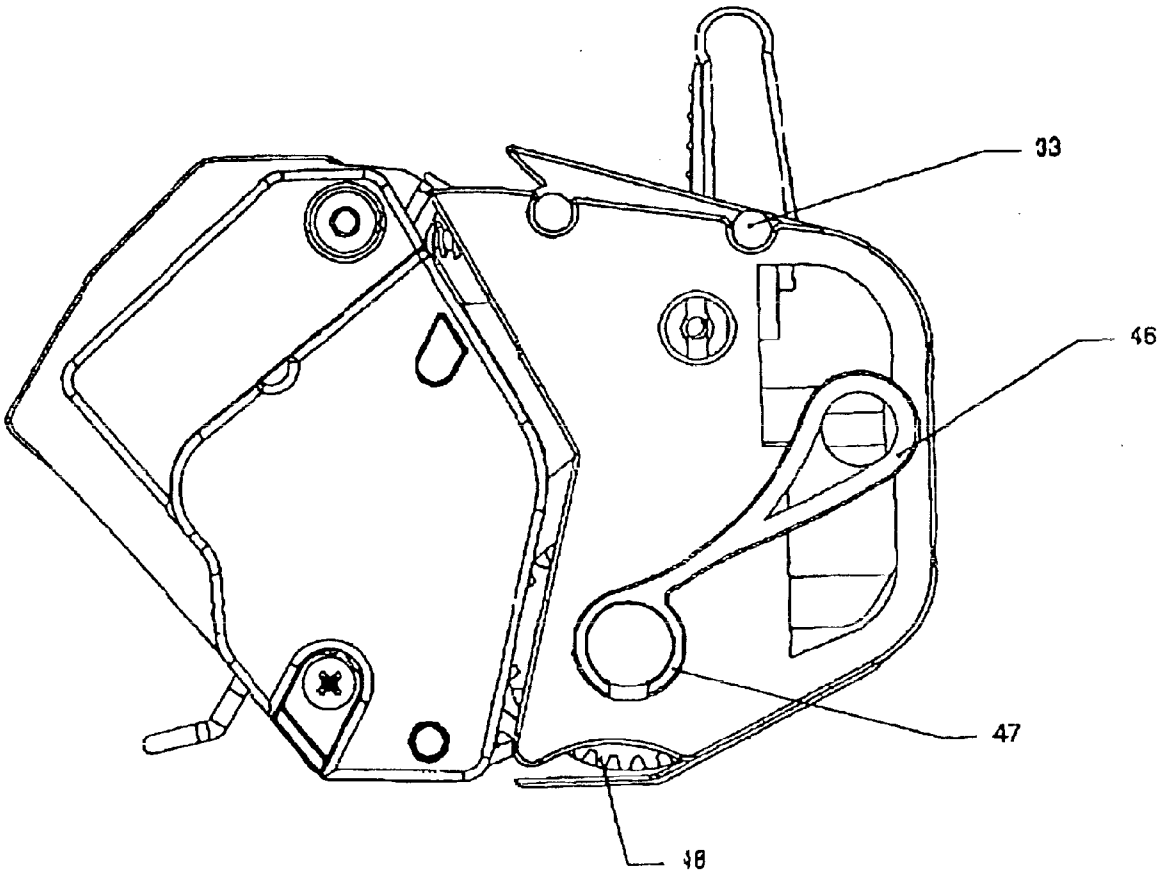
FIGS. 6A and 6B show elements within an image forming apparatus which interact with the respective lateral ends of a process unit.

FIG. 6A shows the opposite end of the process unit from FIG. 5A. Again there are two bosses (46) and (47) which are designed to slide along the guideway in the image forming apparatus. There is also shown peg (33) which provides for the cover opening. Another physical interaction is a gear set (48) mounted on the electrophotographic member designed to engage with a driving gear in the image forming apparatus and also (not shown) a driven gear to rotate the transfer roller.

Figure 6B:
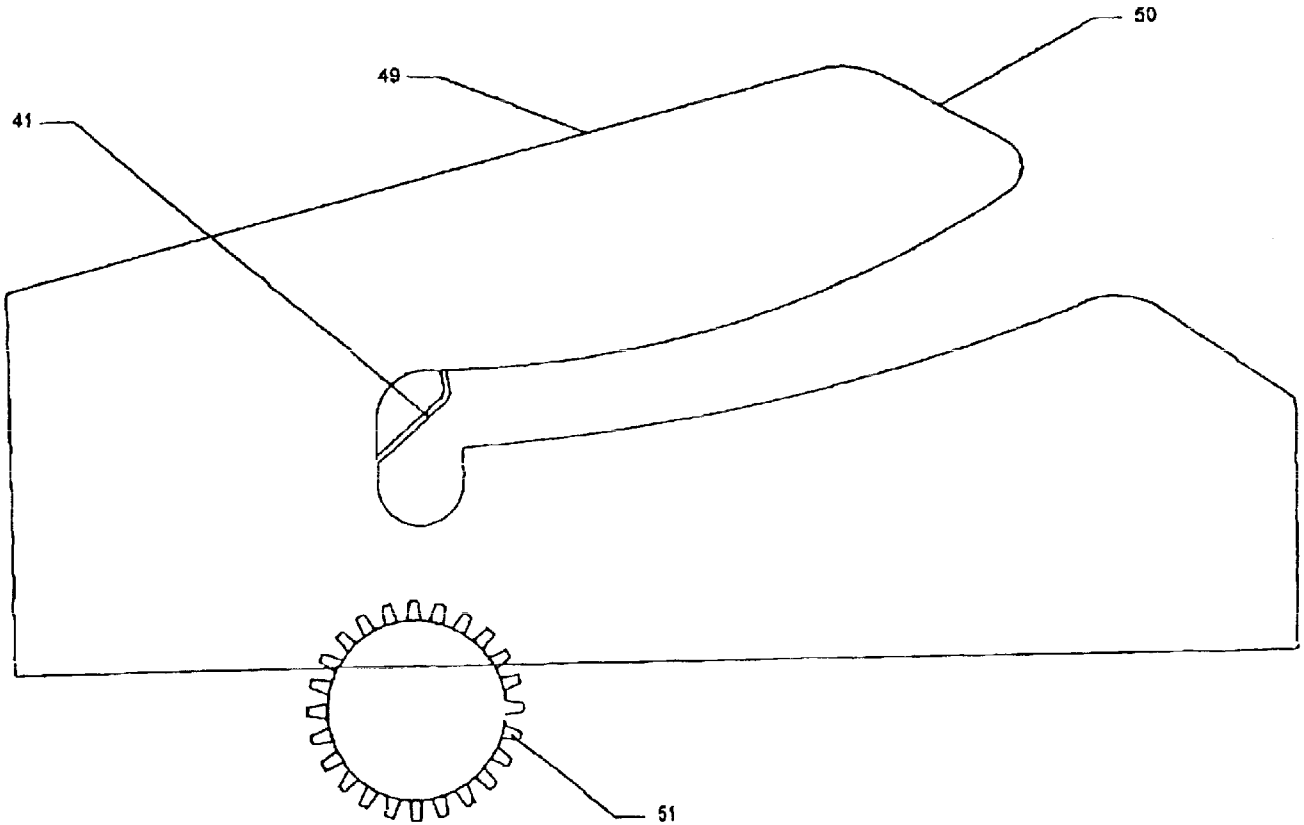

FIG. 6B shows the interactions in the image forming apparatus corresponding to those detailed in FIG. 6A. Illustrated are the moulding (49) with surface (50) to engage the drum cover opening peg; and drive gear (51) which drives the electrophotographic member gear which in turn drives the transfer roller gear.

From the above description it can be seen that the process unit makes a lot of sliding interactions as it is moved into its operating position and furthermore the frictional resistance of these interactions can be unbalanced from one side of the process unit to the other. Secondly the process unit is forced to tilt backwards and forwards as it is inserted. This is shown in FIG. 7. At stage 1 in FIG. 7 the process unit (23) is lowered into the opening of the opened image forming apparatus (56). For Stage 2 the attitude of the process unit is changed in order to swing the unit anticlockwise forwards and downwards into the image forming area. Step 3 involves swinging the unit clockwise again and finally dropping it perpendicularly downwards into its operational position, abutting the transfer roller (which is not shown).

According to the present invention the drum cover is opened before the process unit slides into position hence eliminating one of the interactions between process unit and image forming apparatus during the installation process. Two embodiments are presented here.

Figure 8A:
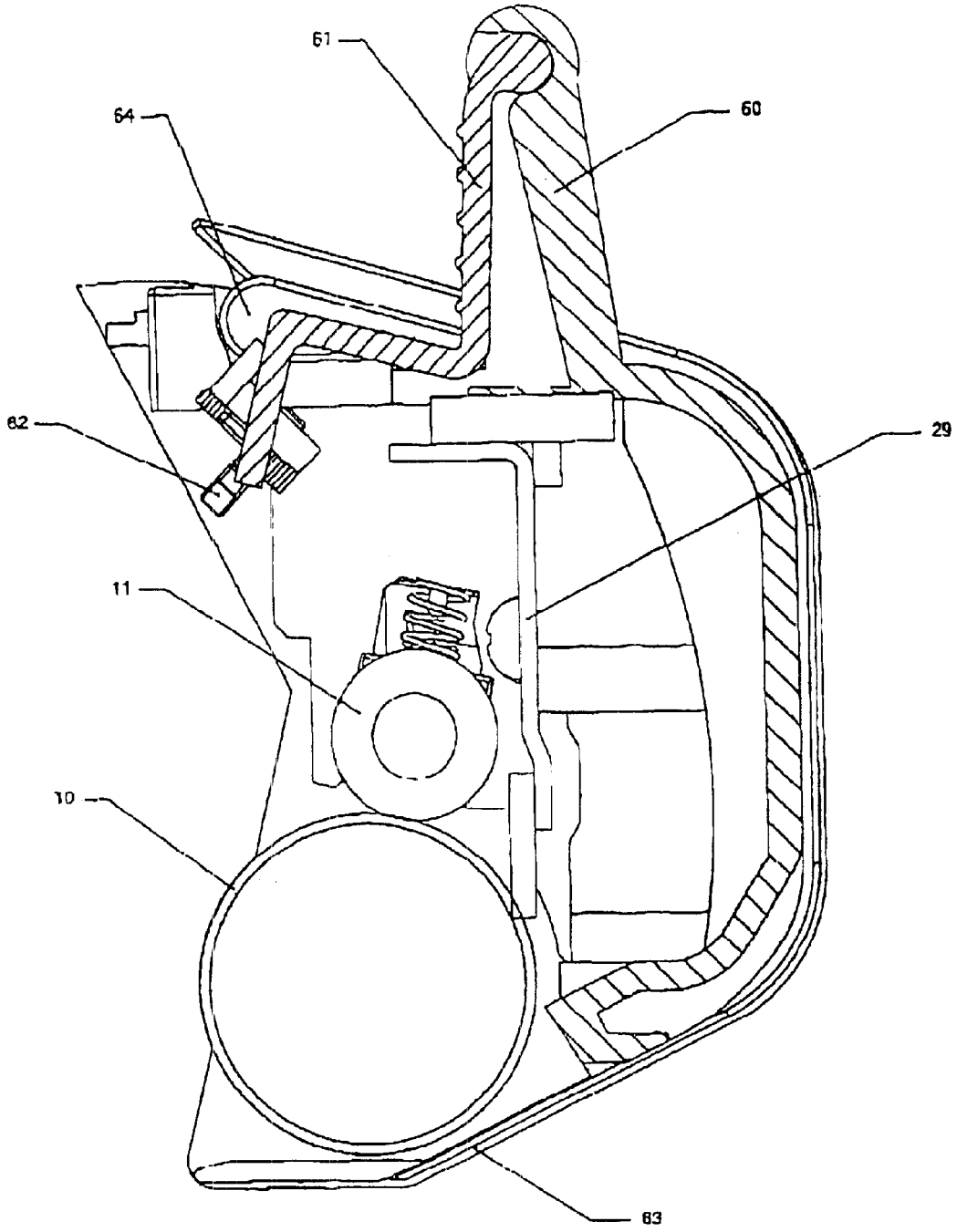
FIGS. 8A and 8B show the preferred embodiment of the current invention.

FIG. 8A shows a section of a similar type of process unit to that previously shown. This time only the semi-section containing the electrophotographic member is shown, for clarity. The process components in this semi-section are the electrophotographic member (10), the Charge Roller (11) and the Cleaning Blade (29). It can be seen that the handle is divided into a fixed portion (60) and a rotatable portion (61). In response to grasping and squeezing the handle, the rotation of panel (61) via linkages (62) opens the cover (63) via the hinge point (64).

Figure 8B:
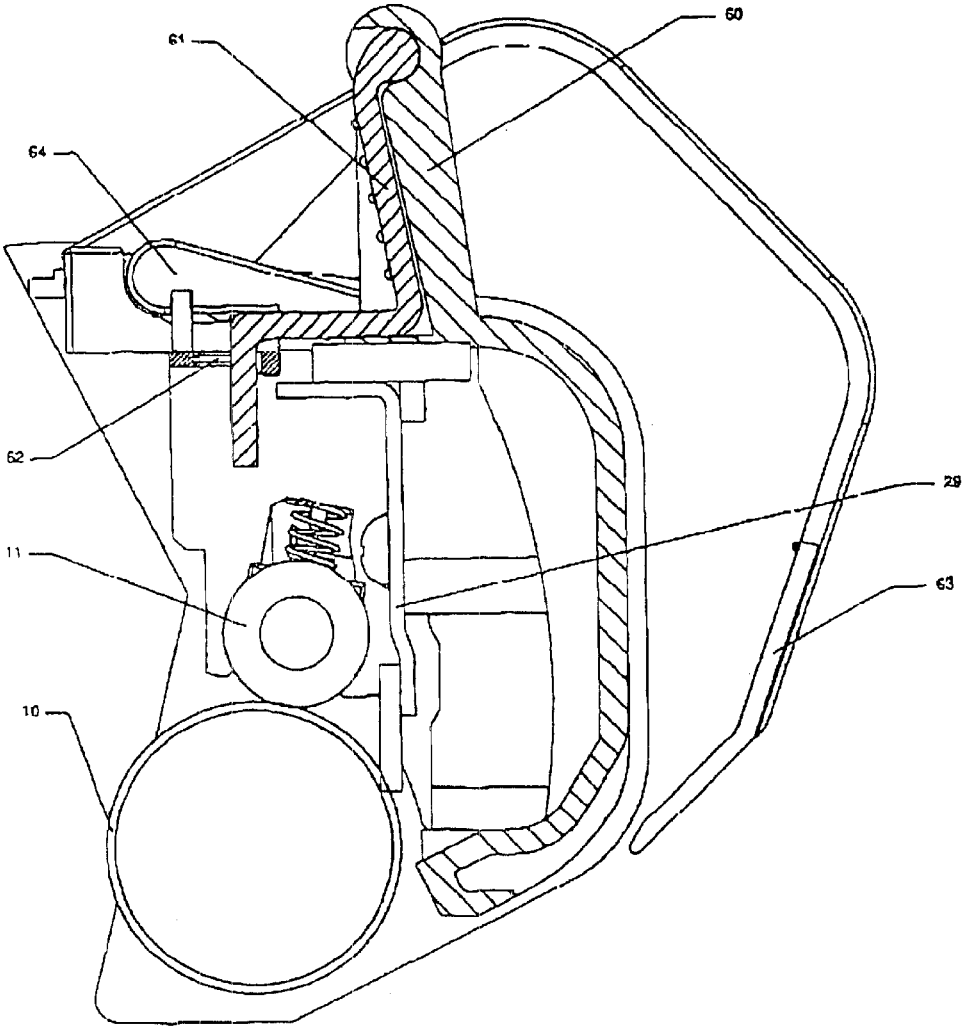

FIG. 8B illustrates the same example in the cover-opened position. In this position the rotatable portion of the handle (61) is flush with the fixed portion (60) and the cover (63) has rotated about the hinge (64) to allow the electrophotographic member to contact the transfer roller (not shown) when the process unit is inserted in the image forming apparatus.

Figure 9A:
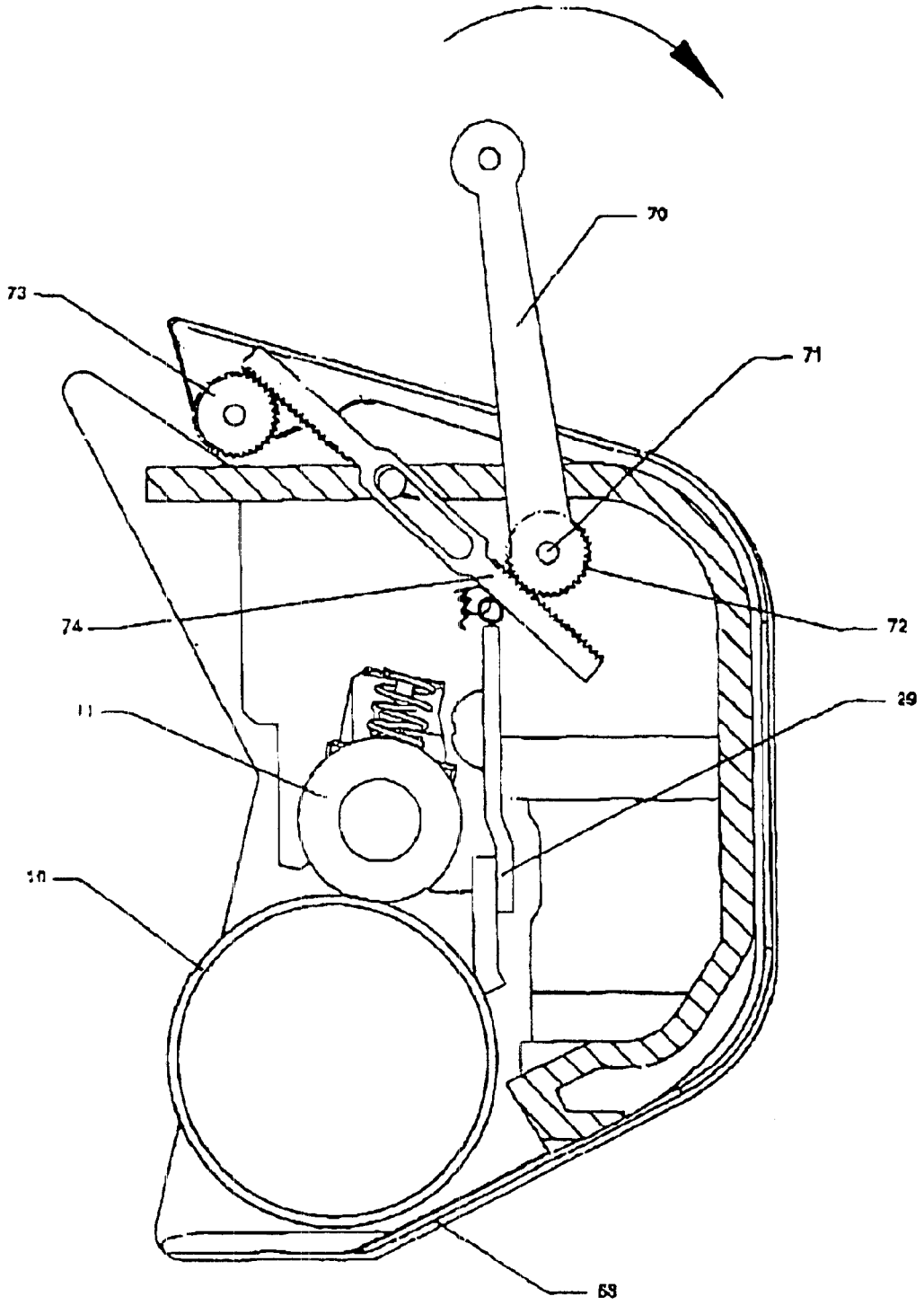
FIGS. 9A and 9B show another embodiment using a different linkage between handle and cover and utilising a gear arrangement operated by the tilting of the handle during installation.
Figure 9B:
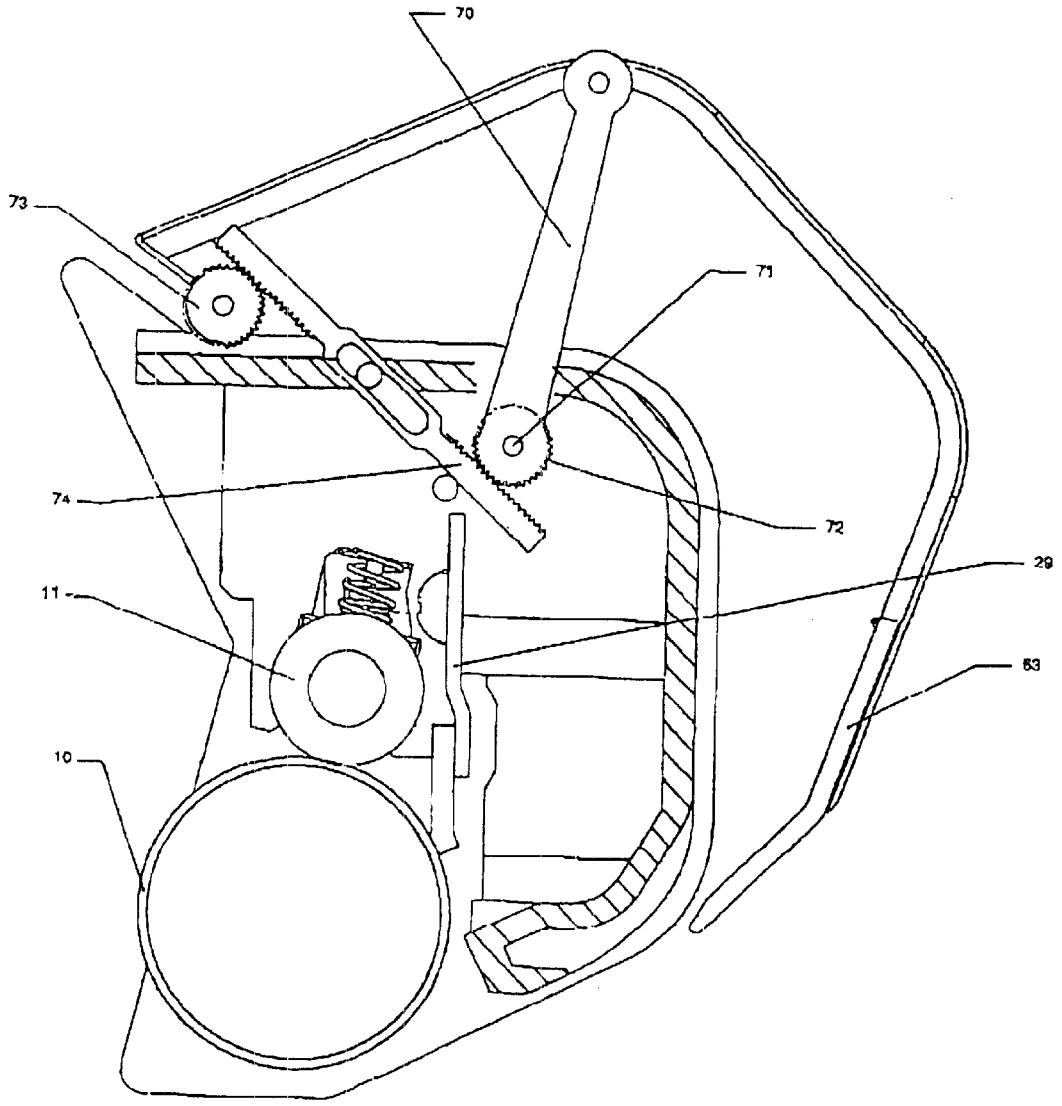

The second embodiment is shown in FIGS. 9A and 9B. FIG. 9A shows the cover-closed position. The handle (70) is rotatable about a pivot (71) which is the centre of a partial gear wheel (72). A similar partial gear wheel (73) is provided at the hinge of the drum cover (63) and the two gears are linked by a sliding rack member (74). When the process unit is picked up by the user and tilted in preparation for insertion into the image forming apparatus, the handle (70) rotates about its pivot (71) in the direction of the arrow and via the rack member the cover is rotated open. FIG. 9B shows the cover in the opened position.

Figure 10:
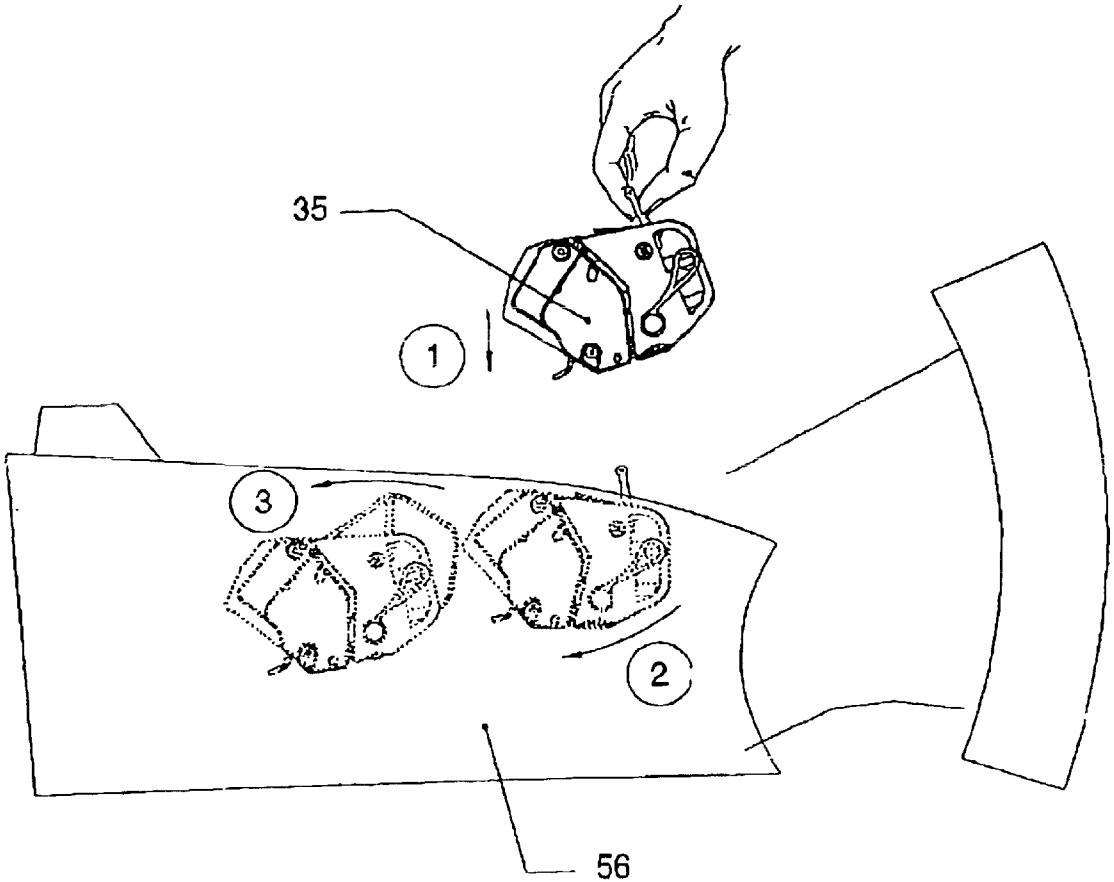
FIG. 10 shows the second embodiment during the same 3 stages of the insertion process as FIG. 7.

FIG. 10 is equivalent to FIG. 7 and showing the second embodiment of the invention whereby the ergonomics of process unit insertion are improved by enabling the handle to tilt.

While the present invention has been illustrated by the description of various embodiments and whilst these embodiments have been described in detail, it is not the intention to restrict or in any way limit the scope of the appended claims to such detail. Additional advantages in modifications will readily appear to those skilled in the art.

The invention in its broader aspects is therefore not limited to the specific details and illustrative examples shown and described. Accordingly departures may be made from such details without departing from the spirit or scope of the applicant's general inventive concept.

What is claimed is:

1. A process unit for use in an electrophotographic image forming apparatus comprising:

a carrying handle;

a photosensitive member;

process means;

a movable cover connected to the process unit and shielding an area of the periphery of photosensitive member;

arranged such that the cover is designed to retract from its shielding position before the process unit is installed into the body of the image forming apparatus and where the cover is caused to retract by the action of grasping the handle.

2. A process unit according to claim 1 where the handle is constructed of two plates which move relative to one another and relative movement of the plates with respect to each other when the handle is grasped, cause the cover to retract from its shielding position.

3. A process unit according to claim 1 where the handle is moveable about a pivot from a first position where the cover is closed to a second position where the cover is retracted from its shielding position.

4. A process unit according to claim 3 where the handle rotates from the first to the second position as the process unit is tilted to enter the image forming apparatus.

* * * * *